US008950379B2

(12) United States Patent
Hattar et al.

(10) Patent No.: US 8,950,379 B2
(45) Date of Patent: Feb. 10, 2015

(54) MEASURED FUEL RAIL PRESSURE ADJUSTMENT SYSTEMS AND METHODS

(75) Inventors: Rafat F. Hattar, Royal Oak, MI (US); Jeffrey M. Hutmacher, Fenton, MI (US); Paul D. Donar, Fenton, MI (US); Alexander Michel, Rheinböllen (DE); Daniel Weinand, Wiesbaden (DE); Dieter Wiedenhöft, Waldfischbach (DE)

(73) Assignee: GM Global Technology Operations LLC

( * ) Notice: Subject to any disclaimer, the term of this patent is extended or adjusted under 35 U.S.C. 154(b) by 347 days.

(21) Appl. No.: 13/596,448

(22) Filed: Aug. 28, 2012

(65) Prior Publication Data

US 2014/0067232 A1 Mar. 6, 2014

(51) Int. Cl.

| | |
|---|---|
| ***F02M 69/54*** | (2006.01) |
| ***F02M 69/46*** | (2006.01) |
| ***F02M 63/02*** | (2006.01) |

(52) U.S. Cl.

CPC ..... *F02M 69/465* (2013.01); *F02M 63/023* (2013.01)

USPC ..... 123/456; 123/457

(58) Field of Classification Search

CPC F02M 63/023; F02M 69/465; F02M 63/0265

USPC ..... 123/456, 457, 510, 511; 701/103, 107, 701/112

See application file for complete search history.

(56) References Cited

U.S. PATENT DOCUMENTS

| | | | | |
|---|---|---|---|---|
| 7,806,106 | B2 * | 10/2010 | Cinpinski et al. | 123/446 |
| 8,061,329 | B2 * | 11/2011 | Pursifull et al. | 123/446 |
| 8,220,322 | B2 * | 7/2012 | Wang et al. | 73/114.43 |
| 8,590,510 | B2 * | 11/2013 | Surnilla et al. | 123/431 |

* cited by examiner

*Primary Examiner* — Hai Huynh

(57) ABSTRACT

A system for a vehicle includes a pump control module, an adjustment determination module, and an adjusting module. The pump control module selectively disables pumping of a fuel pump that is driven by a spark ignition direct injection (SIDI) engine. A predetermined period after the pumping of the fuel pump is disabled, the adjustment determination module determines a pressure adjustment for a first fuel rail pressure measured using a fuel rail pressure sensor. The adjusting module generates a second fuel rail pressure based on the pressure adjustment and the first fuel rail pressure.

20 Claims, 3 Drawing Sheets

MEASURED FUEL RAIL PRESSURE ADJUSTMENT SYSTEMS AND METHODS

FIELD

The present application relates to internal combustion engines and more particularly to control systems and methods for adjusting fuel rail pressures measured by fuel rail pressure sensors.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Air is drawn into an engine through an intake manifold. A throttle valve and/or engine valve timing controls airflow into the engine. The air mixes with fuel from one or more fuel injectors to form an air/fuel mixture. The air/fuel mixture is combusted within one or more cylinders of the engine. Combustion of the air/fuel mixture may be initiated by, for example, injection of the fuel or spark provided by a spark plug.

Combustion of the air/fuel mixture produces torque and exhaust gas. Torque is generated via heat release and expansion during combustion of the air/fuel mixture. The engine transfers torque to a transmission via a crankshaft, and the transmission transfers torque to one or more wheels via a driveline. The exhaust gas is expelled from the cylinders to an exhaust system.

An engine control module (ECM) controls the torque output of the engine. The ECM may control the torque output of the engine based on driver inputs and/or other inputs. The driver inputs may include, for example, accelerator pedal position, brake pedal position, and/or one or more other suitable driver inputs. The other inputs may include, for example, cylinder pressure measured using a cylinder pressure sensor, one or more variables determined based on the measured cylinder pressure, and/or one or more other suitable values.

SUMMARY

A system for a vehicle includes a pump control module, an adjustment determination module, and an adjusting module. The pump control module selectively disables pumping of a fuel pump that is driven by a spark ignition direct injection (SIDI) engine. A predetermined period after the pumping of the fuel pump is disabled, the adjustment determination module determines a pressure adjustment for a first fuel rail pressure measured using a fuel rail pressure sensor. The adjusting module generates a second fuel rail pressure based on the pressure adjustment and the first fuel rail pressure.

A method for a vehicle includes: selectively disabling pumping of a fuel pump that is driven by a spark ignition direct injection (SIDI) engine; and a predetermined period after the pumping of the fuel pump is disabled, determining a pressure adjustment for a first fuel rail pressure measured using a fuel rail pressure sensor. The method further includes generating a second fuel rail pressure based on the pressure adjustment and the first fuel rail pressure.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
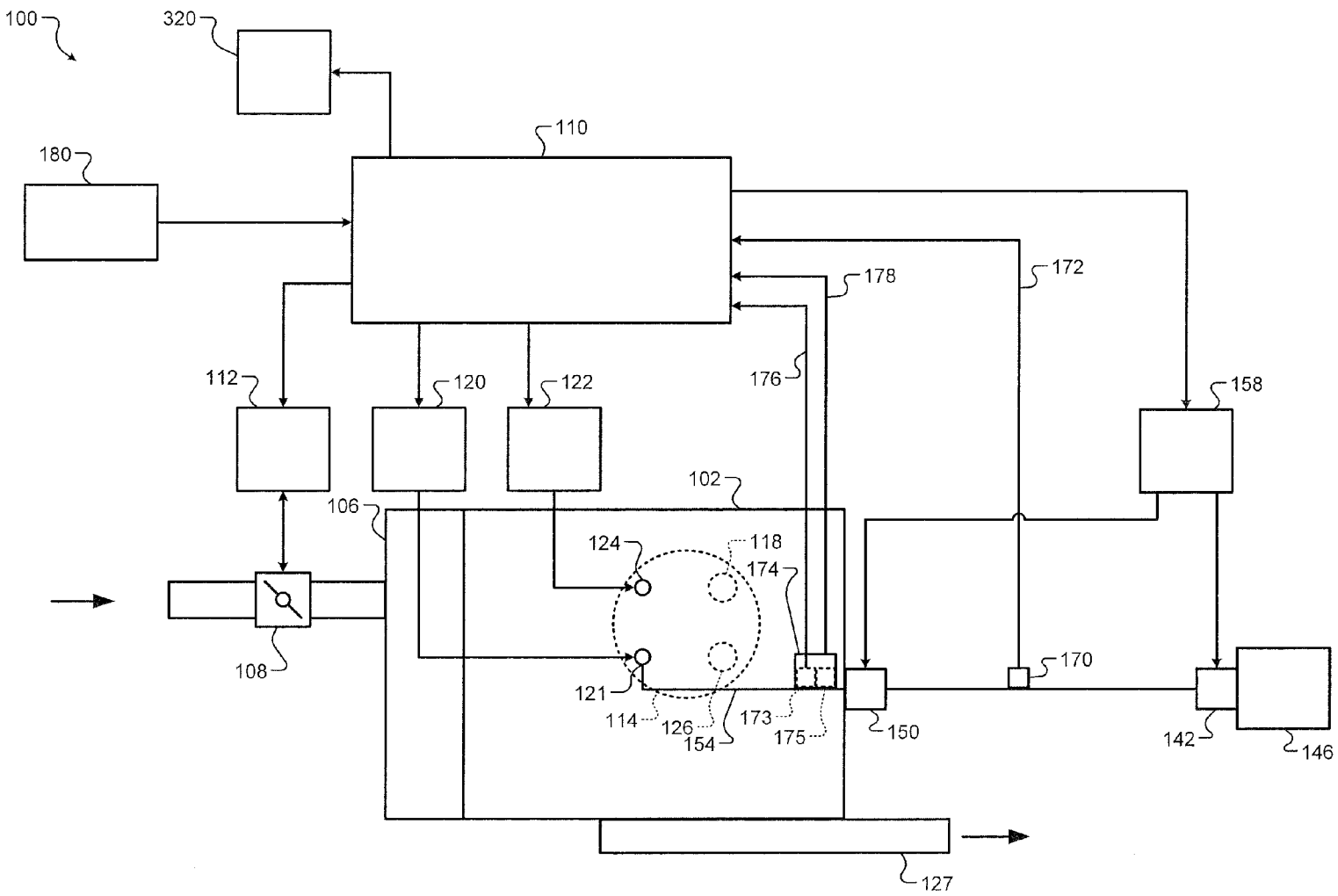
FIG. 1 is a functional block diagram of an example engine system according to the present disclosure.

An engine combusts a mixture of air and fuel within cylinders to generate drive torque. A throttle valve regulates airflow into the engine. Fuel is injected by fuel injectors. Spark plugs may generate spark within the cylinders to initiate combustion. Intake and exhaust valves of a cylinder may be controlled to regulate flow into and out of the cylinder.

The fuel injectors receive fuel from a fuel rail. A high pressure fuel pump receives fuel from a low pressure fuel pump and pressurizes the fuel within the fuel rail. The low pressure fuel pump draws fuel from a fuel tank. A rail pressure sensor includes a first pressure sensor and a second pressure sensor. The first and second pressure sensors each measure pressure within the fuel rail.

A control module controls operation (e.g., stroke, displacement, etc.) of the high pressure fuel pump. The control module may determine a target pressure for the fuel rail and control the high pressure fuel pump based on the target pressure and a pressure within the fuel rail measured using the first pressure sensor. The pressure within the fuel rail measured using the first pressure sensor may also be used for one or more other reasons, such as fuel injection control.

Inaccuracy of the rail pressure sensor, however, may cause improper fueling under some conditions. For example, the inaccuracy may cause improper fueling under some circumstances, such as when the pressure within the fuel rail is less than a predetermined pressure, such as approximately 2 Mega Pascal (MPa).

To determine whether a fault is present in the rail pressure sensor, the control module disables operation of the high pressure fuel pump while the engine runs. While the high pressure fuel pump is disabled, the control module compares measurements generated using the first and second pressure sensors. When a difference between the measurements is greater than a predetermined value, the control module may take one or more remedial actions. For example, the control module may illuminate a malfunction indicator lamp (MIL), control operation of the high pressure fuel pump and/or fuel injection independently of the measurements of the rail pressure sensor, and/or take one or more other suitable remedial actions.

A feed pressure sensor measures a pressure at a location between the low pressure fuel pump and the high pressure fuel pump. The feed pressure sensor is more accurate than the fuel rail pressure sensor due to the narrower operating range of the feed pressure sensor. As such, while the fuel pump is disabled to determine whether a fault is present in the rail pressure sensor, the control module determines adjustments for measurements of the first and second pressure sensors based on comparisons of the measurements of the first and second pressure sensors and the measurements of the feed pressure sensor. The control module adjusts the measurements of the first and second pressure sensors based on their respective adjustments before the measurements of the first and second pressure sensors are used.

Referring now to FIG. 1, a functional block diagram of an example engine system 100 is presented. The engine system 100 includes an engine 102 that combusts an air/fuel mixture to produce drive torque for a vehicle. While the engine 102 will be discussed as a spark ignition direct injection (SIDI) engine, the engine 102 may include another suitable type of engine. One or more electric motors and/or motor generator units (MGUS) may be provided with the engine 102.

Air is drawn into an intake manifold 106 through a throttle valve 108. The throttle valve 108 may vary airflow into the intake manifold 106. For example only, the throttle valve 108 may include a butterfly valve having a rotatable blade. An engine control module (ECM) 110 controls a throttle actuator module 112 (e.g., an electronic throttle controller or ETC), and the throttle actuator module 112 controls opening of the throttle valve 108.

Air from the intake manifold 106 is drawn into cylinders of the engine 102. While the engine 102 may include more than one cylinder, only a single representative cylinder 114 is shown. Air from the intake manifold 106 is drawn into the cylinder 114 through an intake valve 118. One or more intake valves may be provided with each cylinder.

The ECM 110 controls a fuel actuator module 120, and the fuel actuator module 120 controls fuel injection (e.g., amount and timing) by a fuel injector 121. The ECM 110 may control fuel injection to achieve a desired air/fuel ratio, such as a stoichiometric air/fuel ratio. A fuel injector may be provided for each cylinder.

The injected fuel mixes with air and creates an air/fuel mixture in the cylinder 114. Based upon a signal from the ECM 110, a spark actuator module 122 may energize a spark plug 124 in the cylinder 114. A spark plug may be provided for each cylinder. Spark generated by the spark plug 124 ignites the air/fuel mixture. In various implementations, the engine 102 may be selectively operated in a compression ignition (e.g., homogeneous charge compression ignition) mode. During operation in the compression ignition mode, heat generated by compression causes ignition.

The engine 102 may operate using a four-stroke cycle or another suitable operating cycle. The four strokes, described below, are may be referred to as the intake stroke, the compression stroke, the combustion stroke, and the exhaust stroke. During each revolution of a crankshaft (not shown), two of the four strokes occur within the cylinder 114. Therefore, two revolutions crankshaft are necessary for the cylinders to experience all four of the strokes.

During the intake stroke, air from the intake manifold 106 is drawn into the cylinder 114 through the intake valve 118. Injected fuel mixes with air and creates an air/fuel mixture in the cylinder 114. During the compression stroke, a piston (not shown) within the cylinder 114 compresses the air/fuel mixture. During the combustion stroke, combustion of the air/fuel mixture drives the piston, thereby driving the crankshaft. During the exhaust stroke, the byproducts of combustion are expelled through an exhaust valve 126 to an exhaust system 127.

A low pressure fuel pump 142 draws fuel from a fuel tank 146 and provides fuel to a high pressure fuel pump 150. While only the fuel tank 146 is shown, more than one fuel tank 146 may be implemented. The high pressure fuel pump 150 pressurizes the fuel within a fuel rail 154. The fuel injectors the engine 102, including the fuel injector 121, receive fuel via the fuel rail 154. Low pressure, as provided by the low pressure fuel pump 142, is stated relative to high pressure, as provided by the high pressure fuel pump 150.

The low pressure fuel pump 142 may be an electrically driven pump. The high pressure fuel pump 150 may be a variable output pump that is mechanically driven by the engine 102. A pump actuator module 158 controls operation (e.g., output) of the high pressure fuel pump 150. The pump actuator module 158 controls the high pressure fuel pump 150 based on signals from the ECM 110. The pump actuator module 158 may also control application of power (electrical) to the low pressure fuel pump 142.

A feed pressure sensor 170 measures a pressure of the fuel provided to the high pressure fuel pump 150. In other words, the feed pressure sensor 170 measures a pressure of the fuel at a location between the low pressure fuel pump 142 and the high pressure fuel pump 150. The feed pressure sensor 170 generates a feed pressure (FP) signal 172 based on the pressure of the fuel provided to the high pressure fuel pump 150 (feed pressure).

Pressure within the fuel rail 154 may be referred to as rail pressure. A rail pressure sensor 174 includes a first rail pressure sensor 173 and a second rail pressure sensor 175. The first rail pressure sensor 173 measures a first rail pressure and generates a first rail pressure (RP1) signal 176 based on the first rail pressure. The second rail pressure sensor 175 measures a second rail pressure and generates a second rail pressure (RP2) signal 178 based on the second rail pressure.

One or more other sensors 180 may also be implemented. For example, the other sensors 180 may include a mass air flowrate (MAF) sensor, a manifold absolute pressure (MAP) sensor, an intake air temperature (IAT) sensor, a coolant temperature sensor, an oil temperature sensor, a crankshaft position sensor, and/or one or more other suitable sensors.

Figure 2:
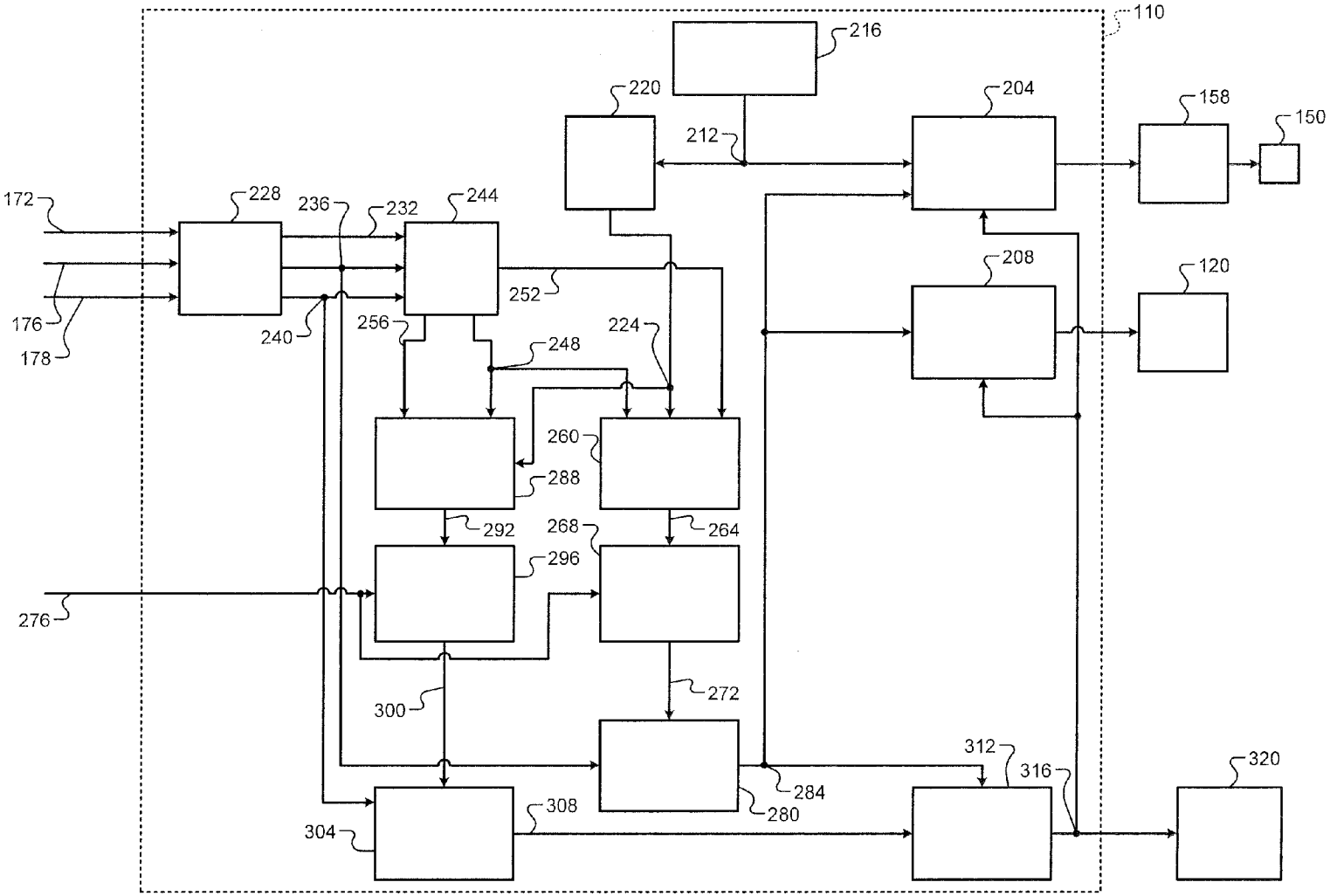
FIG. 2 is a functional block diagram of an example portion of an engine control module according to the present disclosure.

Referring now to FIG. 2, a functional block diagram of an example portion of the ECM 110 is presented. A pump control module 204 controls the high pressure fuel pump 150. For example, the pump control module 204 controls whether the high pressure fuel pump 150 is enabled or disabled and, when the high pressure fuel pump 150 is enabled, the pump control module 204 may control output of the high pressure fuel pump 150. When the high pressure fuel pump 150 is disabled, the high pressure fuel pump 150 does not pressurize fuel in the fuel rail 154. A fuel control module 208 controls fuel injection (e.g., amount, timing, etc.).

The pump control module 204 disables the high pressure fuel pump 150 in response to generation of a trigger 212. Disabling the high pressure fuel pump 150 allows the rail pressure (pressure within the fuel rail 154) to decrease to the feed pressure (pressure between the low pressure fuel pump 142 and the high pressure fuel pump 150).

A triggering module 216 selectively generates the trigger 212, for example, once the fuel control module 208 begins controlling fuel injection in closed-loop based on measurements from one or more exhaust gas oxygen sensors (not shown) after the engine 102 is started. The fuel control module 208 may begin controlling fuel injection in closed-loop based on measurements from one or more exhaust gas oxygen sensors, for example, a predetermined period after the engine 102 is started (e.g., based on actuation of an ignition key, button, etc.).

A timer module 220 resets a pump OFF period 224 to a predetermined reset value (e.g., zero) in response to generation of the trigger 212. The timer module 220 may increment the pump OFF period 224 as time passes and the high pressure fuel pump 150 is disabled in response to the generation of the trigger 212. While resetting the pump OFF period 224 to zero and incrementing the pump OFF period 224 are discussed, the pump OFF period 224 could be set to a predetermined period and decremented as time passes while the high pressure fuel pump 150 is disabled.

A sampling module 228 receives the feed pressure signal 172 from the feed pressure sensor 170. The sampling module 228 also receives the first rail pressure signal 176 from the first rail pressure sensor 173 and the second rail pressure signal 178 from the second rail pressure sensor 175. The sampling module 228 samples the feed pressure signal 172, the first rail pressure signal 176, and the second rail pressure signal 178 to generate feed pressure samples 232, first rail pressure samples 236, and second rail pressure samples 240, respectively. The sampling module 228 may sample the feed pressure signal 172, the first rail pressure signal 176, and the second rail pressure signal 178 at a predetermined sampling rate, such as approximately once every 12.5 milliseconds (ms) or at another suitable sampling rate.

A filtering module 244 receives the feed pressure samples 232, the first rail pressure samples 236, and the second rail pressure samples 240. The filtering module 244 generates a filtered feed pressure 248 based on a predetermined number of the most recent ones of the feed pressure samples 232. The filtering module 244 may set the filtered feed pressure 248, for example, equal to an average of the predetermined number of the most recent ones of the feed pressure samples 232. The predetermined number may be calibratable and may be, for example, approximately 200 or another suitable value.

The filtering module 244 generates a first filtered rail pressure 252 based on the predetermined number of the most recent ones of the first rail pressure samples 236. The filtering module 244 may set the first filtered rail pressure 252, for example, equal to an average of the predetermined number of the most recent ones of the first rail pressure samples 236. The filtering module 244 also generates a second filtered rail pressure 256 based on the predetermined number of the most recent ones of the second rail pressure samples 240. The filtering module 244 may set the second filtered rail pressure 260, for example, equal to an average of the predetermined number of the most recent ones of the second rail pressure samples 240.

A first error module 260 receives the filtered feed pressure 248 and the first filtered rail pressure 252. When the pump OFF period 224 is greater than a predetermined period, the first error module 260 determines a first pressure error 264 based on the filtered feed pressure 248 and the first filtered rail pressure 252. The predetermined period may be calibratable and may be set based on the period necessary for the rail pressure to decrease to the feed pressure while the high pressure fuel pump 150 is disabled. In various implementations, a cumulative amount (e.g., mass) of fuel injected may be tracked while the high pressure fuel pump 150 is disabled, and the first error module 260 may determine the first pressure error 264 in response to a determination that the cumulative amount of fuel injected is greater than a predetermined amount. The predetermined amount may be calibratable and may be set based on the amount of fuel necessary for the rail pressure to decrease to the feed pressure while the high pressure fuel pump 150 is disabled.

The first error module 260 may determine the first pressure error 264 based on a difference between the filtered feed pressure 248 and the first filtered rail pressure 252. The first error module 260 may determine the first pressure error 264 further based on a predetermined pressure loss between the feed pressure sensor 170 and the rail pressure sensor 174. The predetermined pressure loss may be calibratable and may be set based on the characteristics of a given fuel system. For example only, the predetermined pressure loss may be set to approximately 0.030 Mega Pascal (MPa) for an example fuel system.

The first error module 260 may determine the first pressure error 264 as a function of the filtered feed pressure 248, the first filtered rail pressure 252, and the predetermined pressure loss. The function may be embodied as an equation or as a table. For example only, the first error module 260 may set the first pressure error 264 using the equation:

$$FPE=(FFP-PPL)-FFRP,$$

where FPE is the first pressure error 264, PPL is the predetermined pressure loss, and FFRP is the first filtered rail pressure 252. In sum, the first pressure error 264 is set based on a difference between the first rail pressure 236 and the feed pressure 232 at a time when the first rail pressure 236 and the feed pressure 232 should be approximately equal due to the high pressure fuel pump 150 being disabled, while accounting for the predetermined pressure loss. The first error module 260 may determine the first pressure error 264 once per drive cycle. A drive cycle may refer to the period between when a user starts the vehicle (e.g., via an ignition button or key) and when the ECM 110 (and other control modules of the vehicle) enter a sleep mode after the user shuts down the vehicle.

A first adjustment determination module 268 determines a first pressure adjustment 272 for the first rail pressure samples 236 based on the first pressure error 264 and a state of a first learn indicator 276. The first learn indicator 276 may default to an inactive state. When the first learn indicator 276 is in the inactive state, the first adjustment determination module 268 may determine the first pressure adjustment 272 based on the first pressure error 264 and the first pressure adjustment 272. More specifically, the first adjustment determination module 268 determines the first pressure adjustment 272 as a function of the first pressure error 264 and the first pressure adjustment 272 when the first learn indicator 276 is in the inactive state. The function may be embodied as a function or a table. For example only, the first adjustment determination module 268 may determine the first pressure adjustment 272 using the equation:

$$FPA=k*FPE+(1-k)*FPA,$$

where FPA is the first pressure adjustment 272, k is a value between 0.0 and 1.0, and FPE is the first pressure error 264. For example only, k may be approximately 0.02 or another suitable value. This equation may represent a first-order lag filter. In this manner, when the first learn indicator 276 is in the inactive state, the first adjustment determination module 268 slowly adjusts the first pressure adjustment 272 over time as the first rail pressure sensor 173 ages.

When the first learn indicator 276 is in an active state, the first adjustment determination module 268 determines the first pressure adjustment 272 based on the first pressure error 264 and a predetermined large learn value. The first learn indicator 276 may be set to the active state, for example, when memory was reset while the vehicle was shut down (e.g., a battery of the vehicle was disconnected) and/or when an external tool (not shown) is electrically connected to the vehicle (e.g., at a vehicle manufacturing location or at a vehicle service location).

The first adjustment determination module 268 determines the first pressure adjustment 272 as a function of the first pressure error 264 and the predetermined large learn value when the first learn indicator 276 is in the active state. The function may be embodied as a function or a table. For example only, the first adjustment determination module 268 may determine the first pressure adjustment 272 using the equation:

$$FPA=LLV*FPE,$$

where LLV is the predetermined large learn value, FPA is the first pressure adjustment 272, and FPE is the first pressure error 264. The predetermined large learn value is a predetermined value between 0.0 and 1.0. For example only, the predetermined large learn value may be approximately 075, 0.8, or another suitable value. In this manner, when the first learn indicator 276 is in the active state, the first pressure adjustment 272 is set approximately equal to the first pressure error 264.

The first pressure adjustment 272 is used to correct the first rail pressure samples 236 to account for inaccuracy in the first rail pressure sensor 173. A first adjusting module 280 generates first adjusted rail pressure samples 284 based on the first rail pressure samples 236, respectively, and the first pressure adjustment 272. The first adjusting module 280 generates the first adjusted rail pressure 284 at a given time as a function of the first rail pressure 236 at the given time and the first pressure adjustment 272. For example, the first adjusting module 280 may set the first adjusted rail pressure 284 equal to a sum of the first rail pressure 236 and the first pressure adjustment 272.

A second error module 288 receives the filtered feed pressure 248 and the second filtered rail pressure 256. When the pump OFF period 224 is greater than the predetermined period, the second error module 288 determines a second pressure error 292 based on the filtered feed pressure 248 and the second filtered rail pressure 256. As stated above, the predetermined period may be calibratable and may be set based on the period necessary for the rail pressure to decrease to the feed pressure while the high pressure fuel pump 150 is disabled.

The second error module 288 may determine the second pressure error 292 based on a difference between the filtered feed pressure 248 and the second filtered rail pressure 256. The second error module 288 may determine the second pressure error 292 further based on the predetermined pressure loss between the feed pressure sensor 170 and the rail pressure sensor 174.

The second error module 288 may determine the second pressure error 292 as a function of the filtered feed pressure 248, the second filtered rail pressure 256, and the predetermined pressure loss. The function may be embodied as an equation or as a table. For example only, the second error module 288 may set the second pressure error 292 using the equation:

$$SPE=(FFP-PPL)-SFRP,$$

where SPE is the second pressure error 292, PPL is the predetermined pressure loss, and SFRP is the second filtered rail pressure 256. In sum, the second pressure error 292 is set based on a difference between the second rail pressure 240 and the feed pressure 232 at a time when the second rail pressure 240 and the feed pressure 232 should be approximately equal due to the high pressure fuel pump 150 being disabled, while accounting for the predetermined pressure loss. Like the first error module 260, the second error module 288 may determine the second pressure error 292 once per drive cycle.

A second adjustment determination module 296 determines a second pressure adjustment 300 for the second rail pressure samples 240 based on the second pressure error 292 and the state of the first learn indicator 276. When the first learn indicator 276 is in the inactive state, the second adjustment determination module 296 determines the second pressure adjustment 300 based on the second pressure error 292 and the second pressure adjustment 300. More specifically, the second adjustment determination module 296 determines the second pressure adjustment 300 as a function of the second pressure error 292 and the second pressure adjustment 300 when the first learn indicator 276 is in the inactive state. The function may be embodied as a function or a table. For example only, the second adjustment determination module 296 may determine the second pressure adjustment 300 using the equation:

$$SPA=k*SPE+(1-k)*SPA,$$

where SPA is the second pressure adjustment 300, k is the value between 0.0 and 1.0, and SPE is the second pressure error 292. In this manner, when the first learn indicator 276 is in the inactive state, the second adjustment determination module 296 slowly adjusts the second pressure adjustment 300 over time as the second rail pressure sensor 175 ages.

When the first learn indicator 276 is in the active state, the second adjustment determination module 296 determines the second pressure adjustment 300 based on the second pressure error 292 and the predetermined large learn value. As stated above, the first learn indicator 276 may be set to the active state, for example, when memory was reset while the vehicle was shut down (e.g., a battery of the vehicle was disconnected) and/or when an external tool (not shown) is electrically connected to the vehicle (e.g., at a vehicle manufacturing location or at a vehicle service location).

The second adjustment determination module 296 determines the second pressure adjustment 300 as a function of the second pressure error 292 and the predetermined large learn value when the first learn indicator 276 is in the active state. The function may be embodied as a function or a table. For example only, the second adjustment determination module 296 may determine the second pressure adjustment 300 using the equation:

$$SPA=LLV*SPE,$$

where LLV is the predetermined large learn value, SPA is the second pressure adjustment 300, and SPE is the second pressure error 292. As stated above, the predetermined large learn value is a predetermined value between 0.0 and 1.0. For example only, the predetermined large learn value may be approximately 0.75, 0.8, or another suitable value. In this manner, when the first learn indicator 276 is in the active state, the second pressure adjustment 300 is set approximately equal to the second pressure error 292. The first learn indicator 276 may be set to the inactive state once the second pressure adjustment 300 has been determined when the first learn indicator 276 is in the active state. In this manner, the first and second pressure adjustments 272 and 300 will thereafter slowly be adjusted based on the first and second pressure errors 264 and 292, respectively.

The second pressure adjustment 300 is used to correct the second rail pressure samples 240 to account for inaccuracy in the second rail pressure sensor 175. A second adjusting module 304 generates a second adjusted rail pressure 308 based on the second rail pressure 240 and the second pressure adjustment 300. The second adjusting module 304 generates the second adjusted rail pressure 308 at a given time as a function of the second rail pressure 240 at the given time and the second pressure adjustment 300. For example, the second adjusting module 304 may set the second adjusted rail pressure 308 equal to a sum of the second rail pressure 240 and the second pressure adjustment 300.

A fault module 312 determines whether a fault is present in the rail pressure sensor 174 based on the first and second adjusted rail pressures 284 and 308. For example, the fault module 312 may determine that a fault is present in the rail pressure sensor 174 when a difference between the first and second adjusted rail pressures 284 and 308 at a given time is greater than a predetermined value. The predetermined value is greater than zero. The fault module 312 may determine that the fault is present in the rail pressure sensor 174, for example, when the difference between the first and second adjusted rail pressures 284 is greater than the predetermined value on at least X out of the last Y instances, where X and Y are integers greater than one, and X is less than Y.

The fault module 312 generates a sensor fault indicator 316 in response to a determination that the fault is present in the rail pressure sensor 174. Once the determination of whether the fault is present is complete, the pump control module 204 may re-enable the high pressure fuel pump 150. One or more remedial actions may be taken in response to the generation of the sensor fault indicator 316. For example, a malfunction indicator lamp (MIL) 320 may be illuminated in response to the generation of the sensor fault indicator 316.

Additionally or alternatively, the pump control module 204 and/or the fuel control module 208 may control the output of the high pressure fuel pump 150 and fuel injection independently of the first adjusted rail pressure 284 in response to the generation of the sensor indicator fault 316. When the fault module 312 determines that the fault is not present in the rail pressure sensor 174, the pump control module 204 and the fuel control module 208 may control the output of the high pressure fuel pump 150 and fuel injection based on the first adjusted rail pressure 284. For example, the pump control module 204 may control the output of the high pressure fuel pump 150 in closed-loop based on the first adjusted rail pressure 284 and a target rail pressure.

Figure 3:
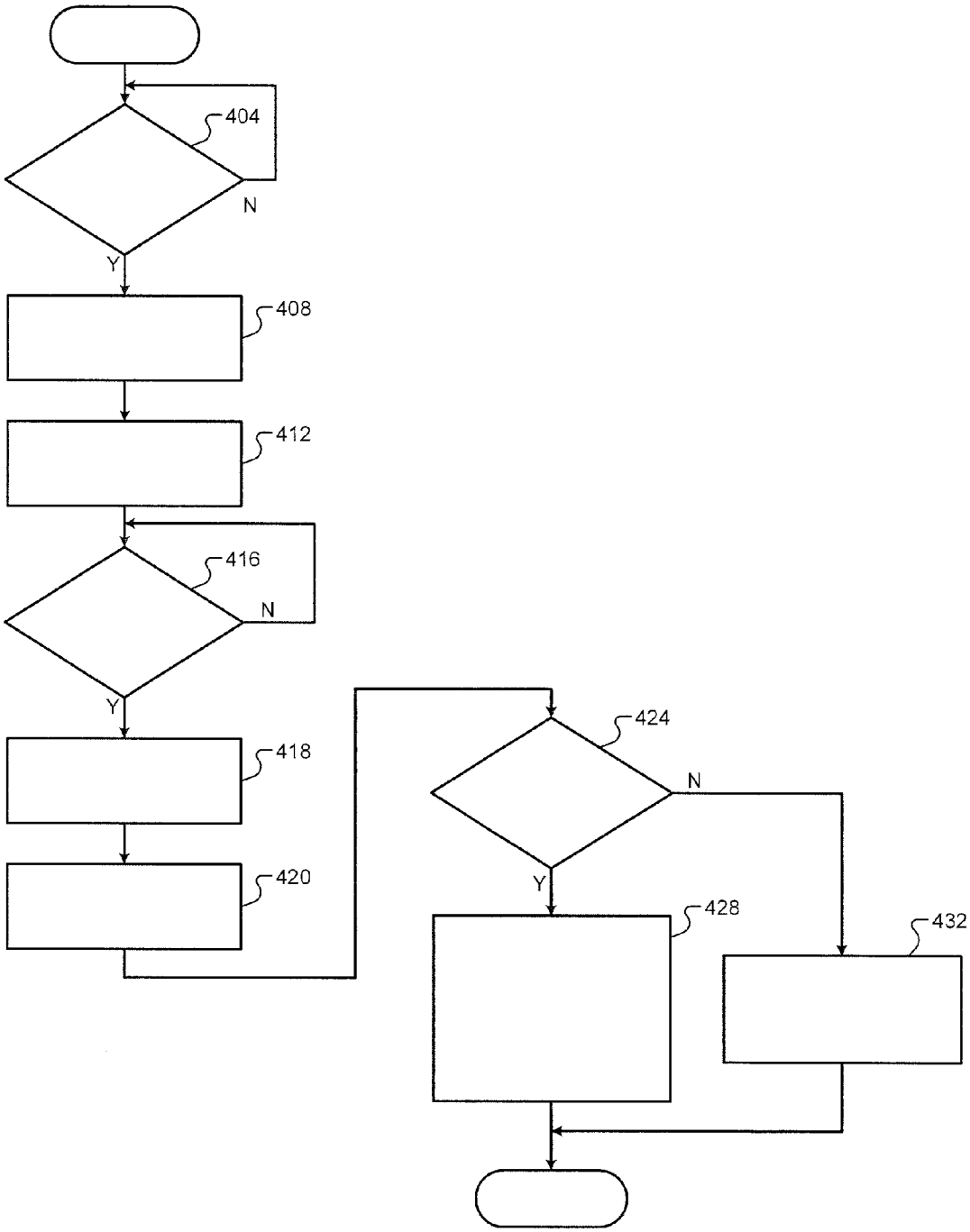
FIG. 3 is a flowchart depicting an example method of determining the rail pressure adjustments for correcting outputs of a fuel rail pressure sensor according to the present disclosure.

Referring now to FIG. 3, a flowchart depicting an example method of determining the first and second pressure adjustments 272 and 300 for correcting the first and second rail pressures 236 and 240, respectively, is presented. Control may begin with 404 where control may determine whether one or more enabling conditions are satisfied. For example only, control may determine whether closed-loop fuel control has begun after a startup of the engine 102. The fuel control module 208 may begin controlling fuel injection in closed-loop based on measurements from one or more exhaust gas oxygen sensors, for example, a predetermined period after the engine 102 is started. Control may additionally or alternatively determine whether one or more other enabling conditions are satisfied at 404. If true, control continues with 408. If false, control may remain at 404 until the one or more enabling conditions are satisfied during the drive cycle.

At 408, control disables the high pressure fuel pump 150. The high pressure fuel pump 150 does not pressurize fuel within the fuel rail 154 when disabled. Disabling the high pressure fuel pump 150 allows the rail pressure to decrease toward the feed pressure. Control continues with 412. At 412, control resets the pump OFF period 224. The pump OFF period 224 tracks the period that the high pressure fuel pump 150 has been disabled.

Control may determine whether the pump OFF period 224 is greater than the predetermined period at 416. Additionally or alternatively, control may determine whether the cumulative amount of fuel injected since the high pressure fuel pump 150 was disabled is greater than the predetermined amount at 416. If true, control continues with 418. If false, control remains at 416, and the pump OFF period 224 (i.e., the period that the high pressure fuel pump 150 has been disabled) continues to increase. The rail pressure may be approximately equal to the feed pressure when the pump OFF period 224 is greater than the predetermined period.

At 418, control may monitor the filtered feed pressure 248 and the first and second filtered rail pressures 252 and 256. At 420, control determines the first and second pressure errors 264 and 292. Control determines the first pressure error 264 as a function of the filtered feed pressure 248 at a given time, the first filtered rail pressure 252 at the given time, and the predetermined pressure loss. Control determines the second pressure error 292 as a function of the filtered feed pressure 248 at a given time, the second filtered rail pressure 256 at the given time, and the predetermined pressure loss. For example, control may determine the first and second pressure errors 264 and 292 using the equations:

$$FPE=(FFP-PPL)-FFRP; \text{ and}$$

$$SPE=(FFP-PPL)-SFRP,$$

respectively, where FPE is the first pressure error 264, PPL is the predetermined pressure loss, FFRP is the first filtered rail pressure 252, SPE is the second pressure error 292, and SFRP is the second filtered rail pressure 256.

At 424, control determines whether the first learn indicator 276 is in the active state. If true, control continues with 428. If false, control continues with 432. At 428 (when the first learn indicator 276 is in the active state), control determines the first and second pressure adjustments 272 and 300 as functions of the first and second pressure errors 264 and 292, respectively, and the predetermined large learn value. For example only, control may determine the first and second pressure adjustments 272 and 300 using the equations:

$$FPA=LLV*FPE; \text{ and}$$

$$SPA=LLV*SPE,$$

respectively, where LLV is the predetermined large learn value, FPA is the first pressure adjustment 272, SPA is the second pressure adjustment 300, FPE is the first pressure error 264, and SPE is the second pressure error 292.

At 432 (when the first learn indicator 276 is in the inactive state), control determines the first and second pressure adjustments 272 and 300 as functions of the first and second pressure adjustments 272 and 300 and the first and second pressure errors 264 and 292, respectively. For example only, control may determine the first and second pressure adjustments 272 and 300 using the equations:

$$FPA=k*FPE+(1-k)*FPA; \text{ and}$$

$$SPA=k*SPE+(1-k)*SPA,$$

respectively, where FPA is the first pressure adjustment 272, k is a predetermined value between 0.0 and 1.0, FPE is the first pressure error 264, SPA is the second pressure adjustment 300, and SPE is the second pressure error 292. For example only, k may be approximately 0.02 or another suitable value.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

What is claimed is:

1. A system for a vehicle, comprising:

a pump control module that selectively disables pumping of a fuel pump that is driven by a spark ignition direct injection (SIDI) engine;

an adjustment determination module that, a predetermined period after the pumping of the fuel pump is disabled, determines a pressure adjustment for a first fuel rail pressure measured using a fuel rail pressure sensor; and an adjusting module that generates a second fuel rail pressure based on the pressure adjustment and the first fuel rail pressure.

2. The system of claim 1 wherein the pump control module selectively enables the pumping of the fuel pump after the determination of pressure adjustment and that controls pumping of the fuel pump based on the second fuel rail pressure.

3. The system of claim 1 further comprising a fuel control module that selectively controls fueling of the SIDI engine based on the second fuel rail pressure.

4. The system of claim 1 further comprising:

a second adjustment determination module that, the predetermined period after the pumping of the fuel pump is disabled, determines a second pressure adjustment for a third fuel rail pressure measured using a second fuel rail pressure sensor; and a second adjusting module generates a fourth fuel rail pressure based on the second pressure adjustment and the third fuel rail pressure.

5. The system of claim 4 further comprising a fault module that selectively indicates that a fault is present in at least one of the first and second fuel rail pressure sensors based on a comparison of a predetermined value with a difference between the second and fourth rail pressures.

6. The system of claim 1 further comprising:

a filtering module that generates a filtered rail pressure based on a predetermined number of samples of the first rail pressure; and an error module that determines a pressure error based on a difference between the filtered rail pressure and the first rail pressure, wherein the adjustment determination module determines the pressure adjustment for the first fuel rail pressure based on the difference.

7. The system of claim 6 wherein the filtering module sets the filtered rail pressure equal to an average of the predetermined number of samples of the first rail pressure.

8. The system of claim 6 wherein the error module determines the pressure error further based on a predetermined pressure difference between a pressure at a location of the rail pressure sensor and a pressure at a location between the fuel pump and an electric fuel pump.

9. The system of claim 6 wherein the adjustment determination module selectively sets the pressure adjustment equal to the product of the pressure error and a predetermined value, wherein the predetermined value is a value between 0.5 and 1.0.

10. The system of claim 6 wherein the adjustment determination module selectively sets the pressure adjustment using the equation:

$$PA=k*PE+(1-k)*PA,$$

where k is a predetermined value between 0.0 and 0.25, PE is the pressure error, and PA is the pressure adjustment.

11. A method for a vehicle, comprising:

selectively disabling pumping of a fuel pump that is driven by a spark ignition direct injection (SIDI) engine;

a predetermined period after the pumping of the fuel pump is disabled, determining a pressure adjustment for a first fuel rail pressure measured using a fuel rail pressure sensor; and generating a second fuel rail pressure based on the pressure adjustment and the first fuel rail pressure.

12. The method of claim 11 further comprising:

selectively enabling the pumping of the fuel pump after the determination of pressure adjustment; and controlling pumping of the fuel pump based on the second fuel rail pressure.

13. The method of claim 11 further comprising selectively controlling fueling of the SIDI engine based on the second fuel rail pressure.

14. The method of claim 11 further comprising:

the predetermined period after the pumping of the fuel pump is disabled, determining a second pressure adjustment for a third fuel rail pressure measured using a second fuel rail pressure sensor; and generating a fourth fuel rail pressure based on the second pressure adjustment and the third fuel rail pressure.

15. The method of claim 14 further comprising selectively indicating that a fault is present in at least one of the first and second fuel rail pressure sensors based on a comparison of a predetermined value with a difference between the second and fourth rail pressures.

16. The method of claim 11 further comprising:

generating a filtered rail pressure based on a predetermined number of samples of the first rail pressure;

determining a pressure error based on a difference between the filtered rail pressure and the first rail pressure; and determining the pressure adjustment for the first fuel rail pressure based on the difference.

17. The method of claim 16 further comprising setting the filtered rail pressure equal to an average of the predetermined number of samples of the first rail pressure.

18. The method of claim 16 further comprising determining the pressure error further based on a predetermined pressure difference between a pressure at a location of the rail pressure sensor and a pressure at a location between the fuel pump and an electric fuel pump.

19. The method of claim 16 further comprising selectively setting the pressure adjustment equal to the product of the pressure error and a predetermined value, wherein the predetermined value is a value between 0.5 and 1.0.

20. The method of claim 16 further comprising selectively setting the pressure adjustment using the equation:

$$PA=k*PE+(1-k)*PA,$$

where k is a predetermined value between 0.0 and 0.25, PE is the pressure error, and PA is the pressure adjustment.

* * * * *